US007353548B2

(12) United States Patent
Bartosik

(10) Patent No.: US 7,353,548 B2
(45) Date of Patent: Apr. 8, 2008

(54) KIT FOR PORTABLE WHIRLPOOL BATH

(76) Inventor: Katherine E. Bartosik, 3041 W. Chester Pike, Apartment E3, Broomall, PA (US) 19008

( * ) Notice: Subject to any disclaimer, the term of this patent is extended or adjusted under 35 U.S.C. 154(b) by 487 days.

(21) Appl. No.: 11/176,821

(22) Filed: Jul. 7, 2005

(65) Prior Publication Data

US 2007/0006376 A1 Jan. 11, 2007

(51) Int. Cl.
*A47K 3/00* (2006.01)
*A47K 3/10* (2006.01)

(52) U.S. Cl. ..... 4/541.1

(58) Field of Classification Search ..... 4/541.1–541.6, 4/492, 507, 509, 518, 623
See application file for complete search history.

(56) References Cited

U.S. PATENT DOCUMENTS

| | | | | |
|---|---|---|---|---|
| 2,481,564 A | | 9/1949 | Bjorkman | 4/178 |
| 3,055,357 A | | 9/1962 | Redka | 128/32 |
| 3,157,774 A | | 11/1964 | Moore et al. | 219/326 |
| 3,283,756 A | | 11/1966 | Turley | 128/66 |
| 3,380,080 A | | 4/1968 | Farrell | 4/182 |
| 3,477,424 A | | 11/1969 | Tracy | 128/66 |
| 3,571,818 A | | 3/1971 | Jacuzzi | 4/180 |
| 3,911,505 A | * | 10/1975 | Zaborowsky | 4/541.3 |
| 3,965,495 A | | 6/1976 | McNair | 4/182 |
| 4,796,312 A | * | 1/1989 | Corlew | 4/555 |
| 5,289,598 A | | 3/1994 | Madison, Jr. | 4/541.1 |
| 6,327,721 B1 | | 12/2001 | Devereaux et al. | 4/541.3 |
| 6,401,273 B1 | * | 6/2002 | Fung et al. | 4/559 |
| 6,775,861 B1 | | 8/2004 | Devereaux et al. | 4/538 |
| 6,790,188 B2 | | 9/2004 | Chen | 601/22 |
| 6,805,678 B2 | | 10/2004 | Cafaro | 601/16 |
| 2004/0087883 A1 | | 5/2004 | Berger | 601/167 |
| 2004/0194205 A1 | | 10/2004 | Leung | 4/622 |

OTHER PUBLICATIONS

Sanijet; Pipeless Pedicure Spa Equipment and Foot Massagers; http://www.sanijet.com/footmassage.html?source=Overture; p. 1; Feb. 10, 2005.

Pro-Med Products: Whirlpools; http://www.promedproducts.com/Merchant2/merchant.mv?Screen=CTGY&Store_Code=P...; pp. 1-5; Feb. 10, 2005.

* cited by examiner

*Primary Examiner*—Huyen Le
(74) *Attorney, Agent, or Firm*—Watov & Kipnes, P.C.; Kenneth Wator

(57) ABSTRACT

A kit for a portable hydrotherapy system includes a wheeled vessel having a handle at one end for easy transport, an insert configured for retaining components of a water circulator pump system when not in use, whereby the loaded insert is stored in the vessel with a lid covering an open top of the vessel, and an inverter is attached to an outside sidewall of the vessel. In use, the lid and insert are removed, the water circulator mounted upon one end of the vessel, the vessel filled with cold or warm water, the circulator turned on, and a patient's feet, or feet and ankle, or feet and ankle and calf are placed into the vessel for treatment.

24 Claims, 7 Drawing Sheets

KIT FOR PORTABLE WHIRLPOOL BATH

FIELD OF THE INVENTION

The field of the invention relates generally to whirlpool baths, and more particularly to portable hydrotherapy baths for treating injuries to the extremities.

BACKGROUND OF THE INVENTION

Many systems and devices have been developed for providing cryotherapy and/or hot water therapy, with or without massage, for treating injuries and other physical problems associated particularly with the extremities or limbs of patients. Many of these devices, typically providing whirlpool bath systems, are relatively heavy, quite large, and typically are fixed in position in a treatment center or in a patient's home. Such large systems even with wheels attached are still cumbersome and difficult to move from one location to another. Very small whirlpool and massage devices have been developed that are designed for immersing a patient's feet, and perhaps a small portion of their ankles in hot or cold water, which is circulated by a small circulating pump typically built into the device. Although portable and easy to carry, such devices are generally not suitable for use by athletic trainers, physical therapists, and other health providers in providing necessary treatment for relieving symptoms developed in a patient's foot, ankle, and/or legs such as splints, stress factors, sore calf muscles, turf toe, and tight muscles, and prevalent aching or tired feet. There is a need in the art for easily movable, relatively lightweight portable whirlpool baths for use by professional health care providers, that can be self-powered or powered from a standard AC outlet, and are easily transportable from one site to the other, be it a playing field, a gymnasium, a swim center, or even a patient's home.

SUMMARY OF THE INVENTION

An object of the invention is to provide an improved kit for a portable whirlpool bath system;

Another object of the invention is to provide an easily transportable whirlpool bath system useful by both professional health care givers, and by patients themselves in their homes; and Yet another object of the invention is to provide a kit for a portable whirlpool system that can be either self-powered in remote locations, or powered from standard AC wall outlets when available.

With these and other objects, in mind, in one embodiment of the present invention, an insulated vessel, tank, or tub for containing chilled or hot water includes means for easily moving and transporting the same, and a detachable motorized whirlpool bath for circulating the water deposited therein. The vessel is deep enough for accommodating at least a patient's foot and ankle in one embodiment, and is made deeper in another embodiment for also immersing a patient's entire calf in circulating water. When not in use or prepared for transport, the present systems includes an interior ledge projecting from the inside walls for receiving a circumferential lip of an insert configured for holding all of the component parts of the motorized whirlpool pump system, whereby the lip of the insert and the interior ledge of the vessel are interoperatively configured for receiving an interior projecting portion of a lid for both securing the insert in place, and for closing off the open top of the vessel. In another embodiment of the invention, a self-contained battery powered inverter unit is removably attached to a sidewall of the vessel for providing AC power to the motorized water circulator pump at times that an AC outlet is not readily available. The batteries of the inverter unit are rechargeable batteries, and the inverter unit can be attached to the sidewall of the vessel by any suitable attachment means, such as Velcro®, for example.

BRIEF DESCRIPTION OF THE DRAWINGS

Various embodiments of the present invention are described below with reference to the drawings, in which like items are identified by the same reference designation, wherein.

DETAILED DESCRIPTION OF THE INVENTION

Figure 1:
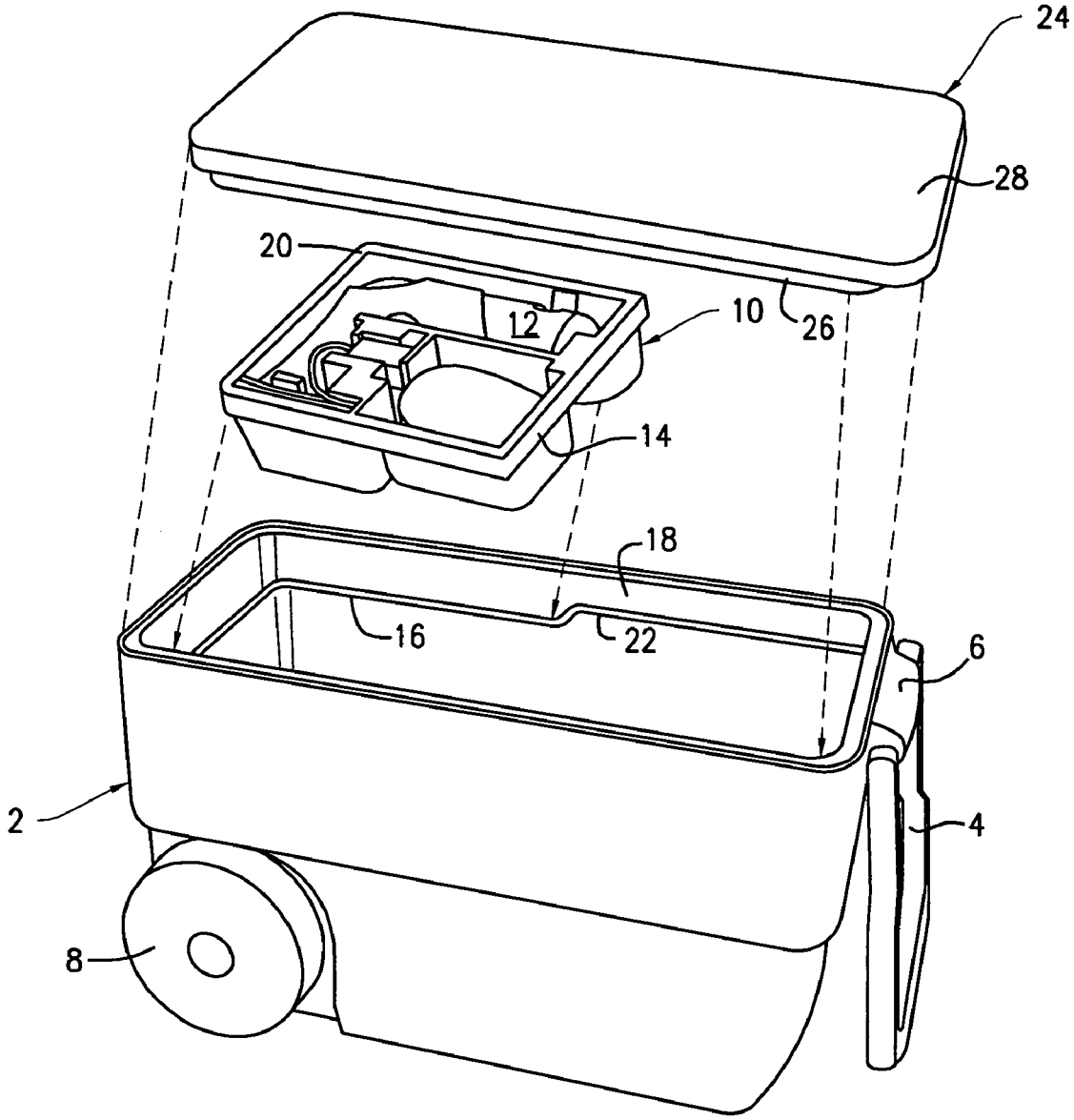
FIG. 1 shows a pictorial view of an exploded assembly diagram for one embodiment of the invention.
Figure 2:
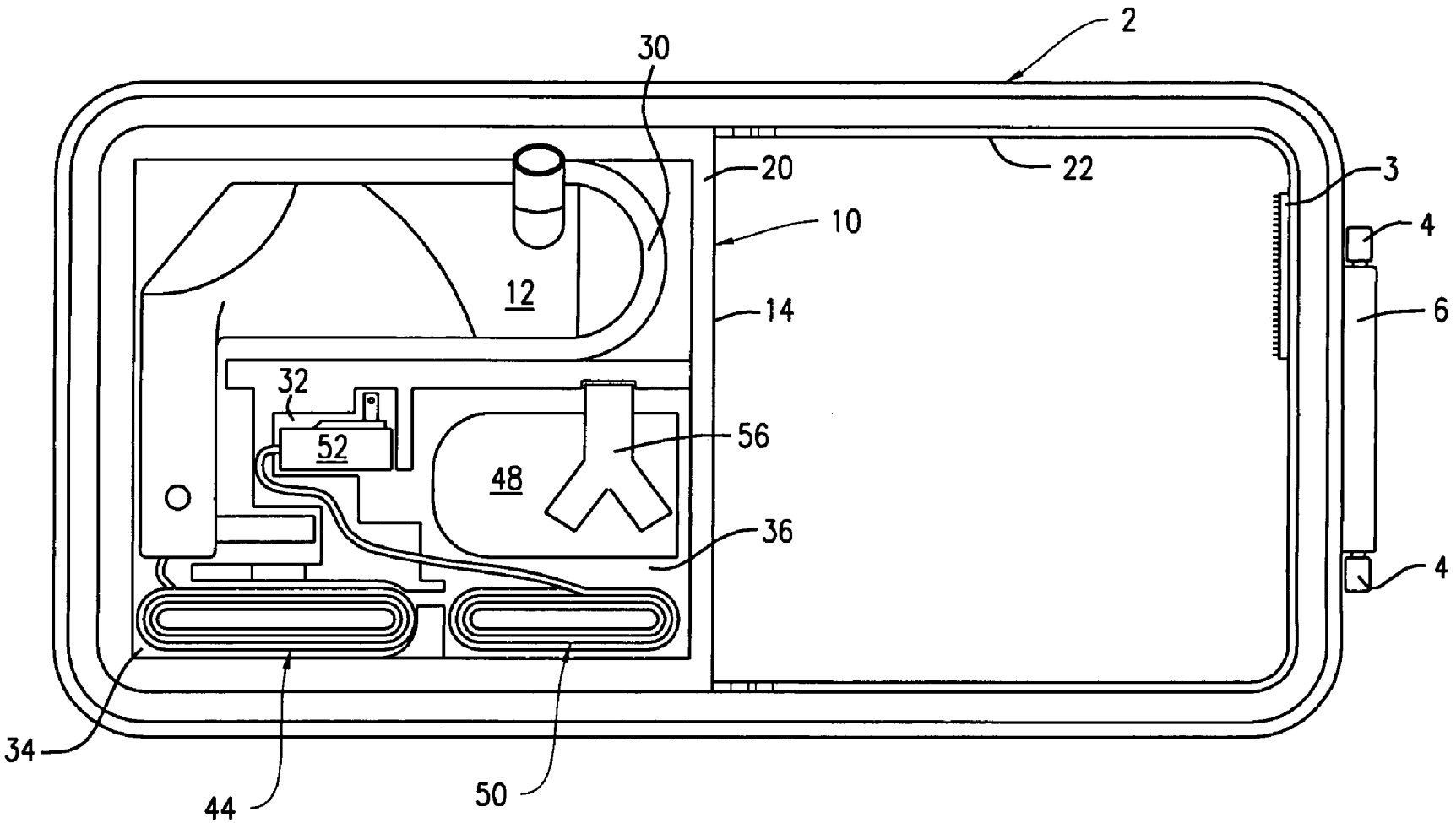
FIG. 2 shows a top plan view of the embodiment of FIG. 1, with the lid of the system removed, and an insert carrying components of a motorized water circulator device installed in the vessel.
Figure 3:
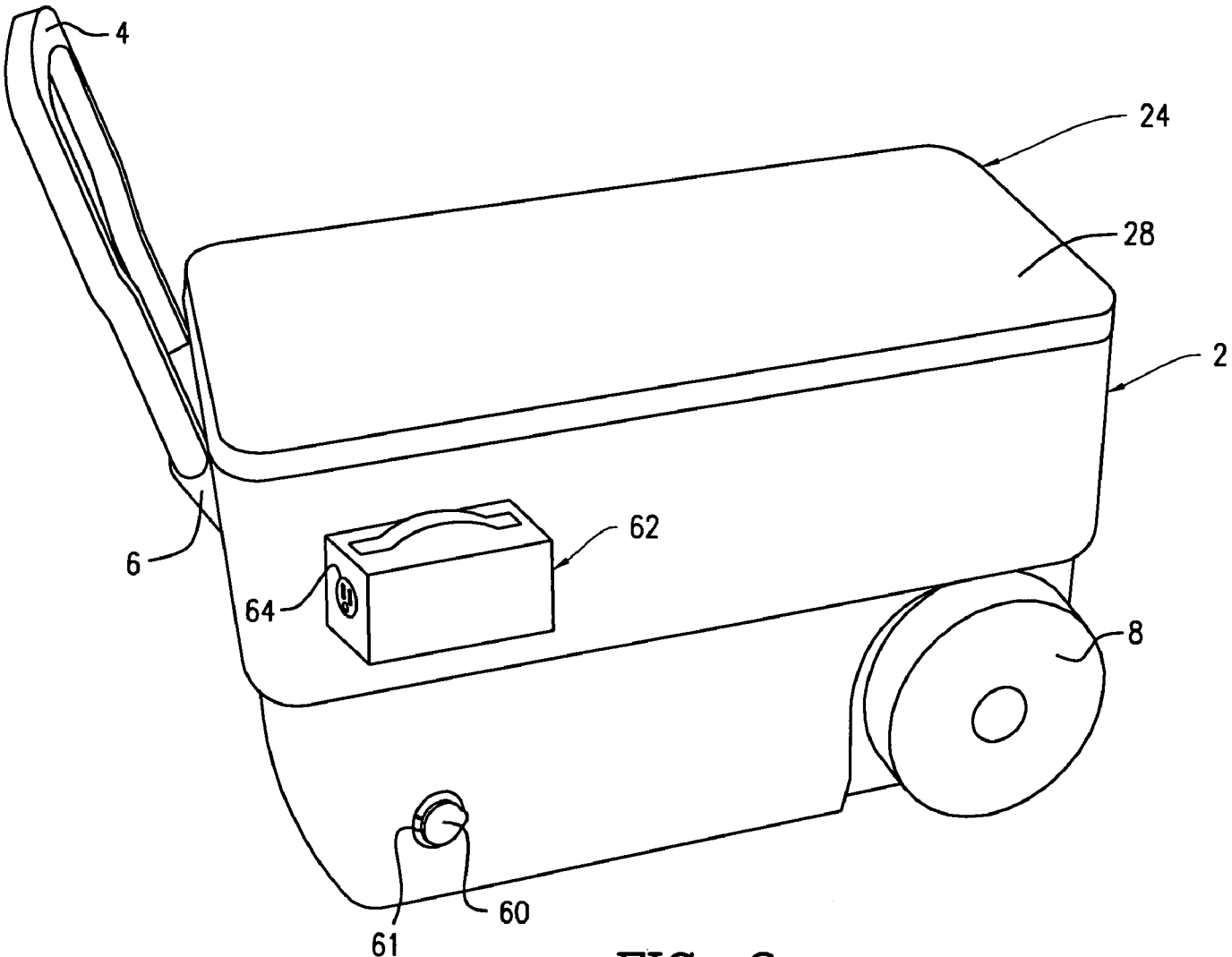
FIG. 3 shows a pictorial view of the system with the lid installed, the system being ready for storage, or transport.

As shown in FIG. 1, one embodiment of the invention includes a tub or vessel 2, preferably made from a thermal insulated material, such as the foam material often found in picnic coolers, for example. The vessel includes a handle 4 that is swivel mounted at its free ends onto a projecting boss 6 from an uppermost portion of one end of the vessel 2. The handle 4 can be swiveled up to a transport position as shown in FIG. 3, for example. A pair of wheels 8 are mounted near the bottom side portions of the vessel 2 proximate the opposite end thereof from the end to which the handle 4 is retained, as shown. A tray insert 10 is configured to have a plurality of preformed holding cells for retaining components of a motorized water circulator 12, as shown. The tray insert 10 includes an extending circumferential lip 14 configured for having the underside thereof rest upon an interior lowermost ledge 16 extending from the inner sidewall 18 of the vessel 2. When the tray insert 10 is installed in the vessel 2 and resting upon the lowermost ledge 16 as shown in FIG. 2, the top portion 20 of the extending circumferential lip 14 is at the same level in the vessel 2 as the uppermost inward extending ledge portion 22. When a lid 24 is installed on top of the vessel 2, a bottommost portion 26 (see FIG. 1) of lid 24 is dimensioned to snugly fit within the opening at the top of the vessel 2 and rest against the uppermost lip portion 20 of tray insert 10 and the uppermost inward extending ledge portion 22. The top portion 28 of the lid 24 is dimensioned to have the same dimensions as the outside circumference of the top opening of the vessel 2. FIG. 3 shows the vessel 2 with the tray lid 10 installed, and the lid 24 in place, showing the present inventive kit ready for transport or storage. In storage the handle 4 can be rotated downward to the position shown in FIG. 1.

Figure 4:
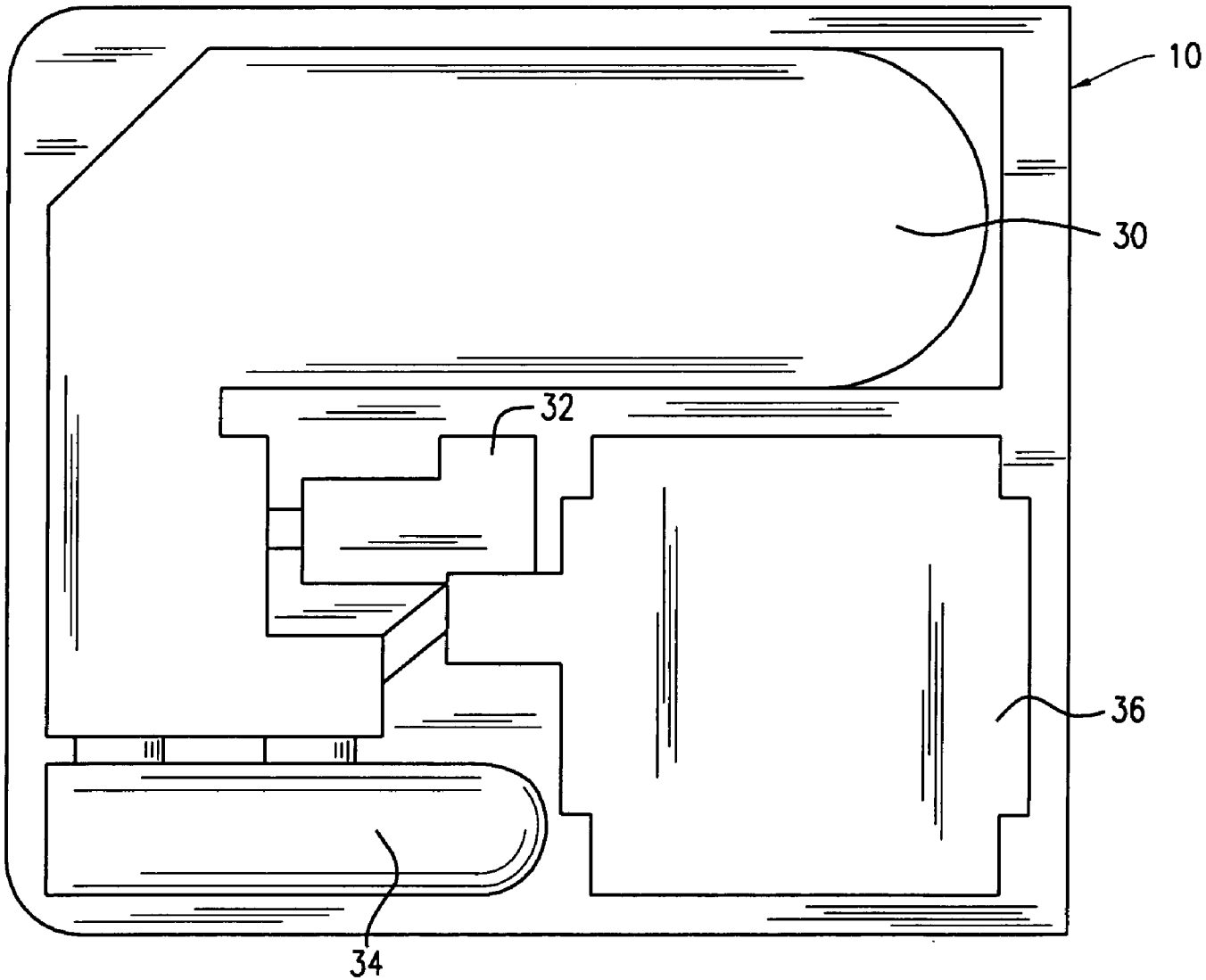
FIG. 4 shows a top plan view of the insert with the components of the motorized whirlpool removed.
Figure 5:
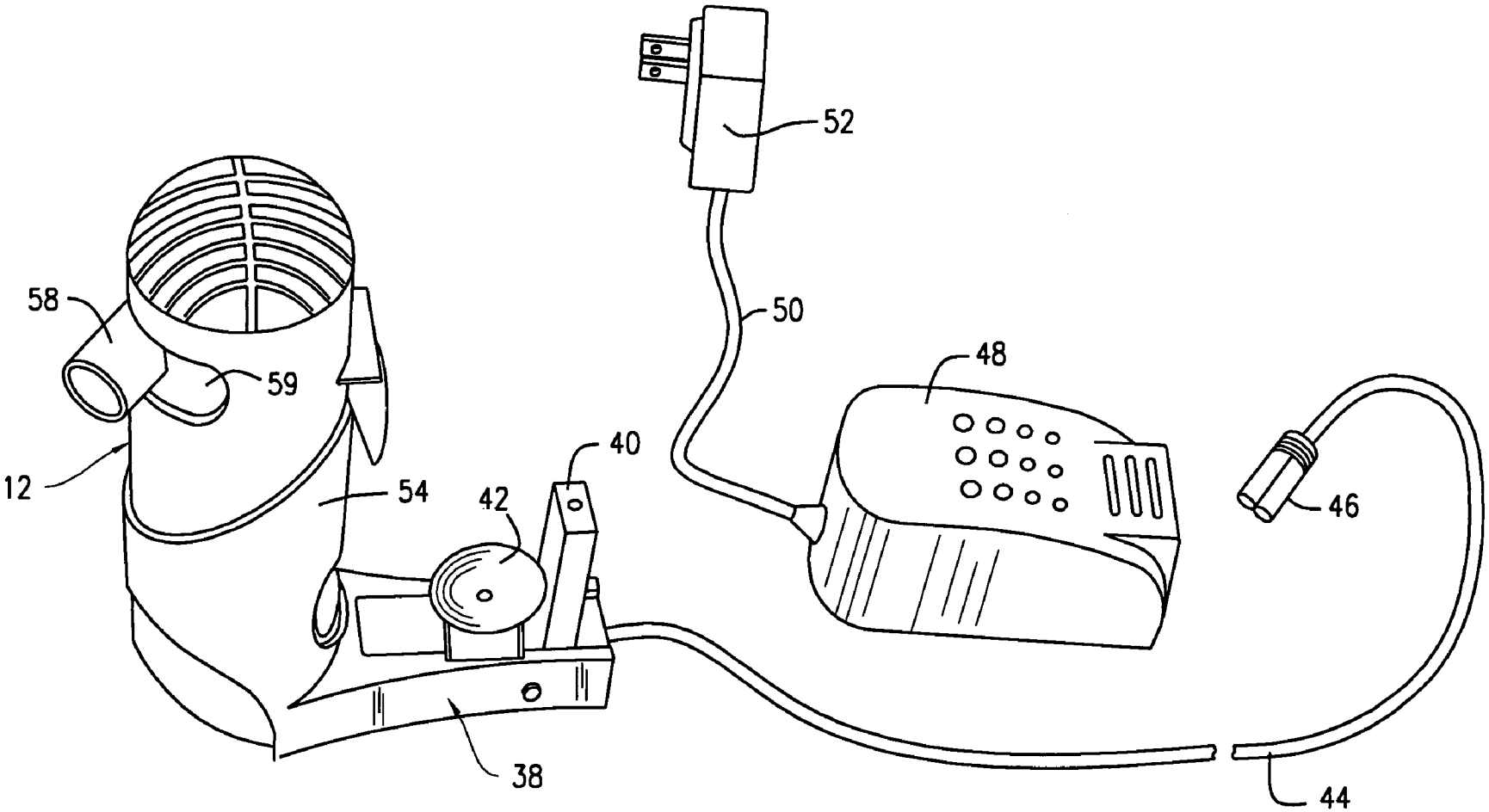
FIG. 5 shows a pictorial view of the components of the motorized water circulator for one embodiment of the invention.

With further reference to FIG. 2, and to FIG. 4, the tray lid insert 10 includes a plurality of cells or cavities 30, 32, 34, and 36. With reference to FIG. 5, in an engineering prototype of the hydrotherapy kit, a Model BTS1R Water Jet Bath Spa from Conair Corporation, provided the motorized water circulator 12. In this example, the water circulator 12 includes a mounting bracket portion 38 having a moveable bracket 40 and a suction cup 42. The water jet or circulator 12 also includes a power cord 44, the end of which terminates at a special plug 46, which plugs into a power pack 48. The power pack 48 includes a power cord 50, the end of which is connected to an AC plug 52, for plugging the power pack 48 into an AC outlet. The water circulator 12 includes a motorized pump 54 integral with mounting bracket 38, which fits into cell 30 of tray insert 10 as shown in FIG. 2, with the power cord 44 and plug 46 contained within cell 34. Note as shown in FIG. 2 that a flow diverter 56 is another of the components for the water jet for circulator 12, in this example, and can be installed on the outlet nozzle 58 of water circulator 12 for directing the water jet therefrom in two different directions.

With further reference to FIG. 3, a drain plug 60 is included in a lower portion of the vessel 2 in an end thereof opposite wheels 8. A living hinge 61 is used to retain the drain plug 60 when it is pulled out of a hole in the side of the vessel 2 that it seals off when in place, to insure that the drain plug 60 is not misplaced and is immediately available for plugging its associated hole after draining water from the vessel 2. In this example, the cap of drain plug 60 is pulled for draining water from the vessel 2. Also shown is a DC-AC inverter 62 that is mounted in a suitable manner, such as by Velcro® 3 (see FIG. 2), for example, on an interior or outer sidewall of the vessel 2. During storage or transport it is preferred that the inverter 62 be mounted on the interior or inside sidewall of vessel 2. The inverter 62 includes an AC outlet 64, and chargeable batteries (not shown), and electronic circuitry for converting the DC voltage from the batteries to AC line voltage provided at AC outlet 64. The inverter 62 is included to provide power to run the water circulator 12 when a conventional AC outlet is not available, such as on an athletic field, for example. A commercially available inverter 62 having a sufficient power rating for driving the water circulator 12 can be employed.

Figure 6:
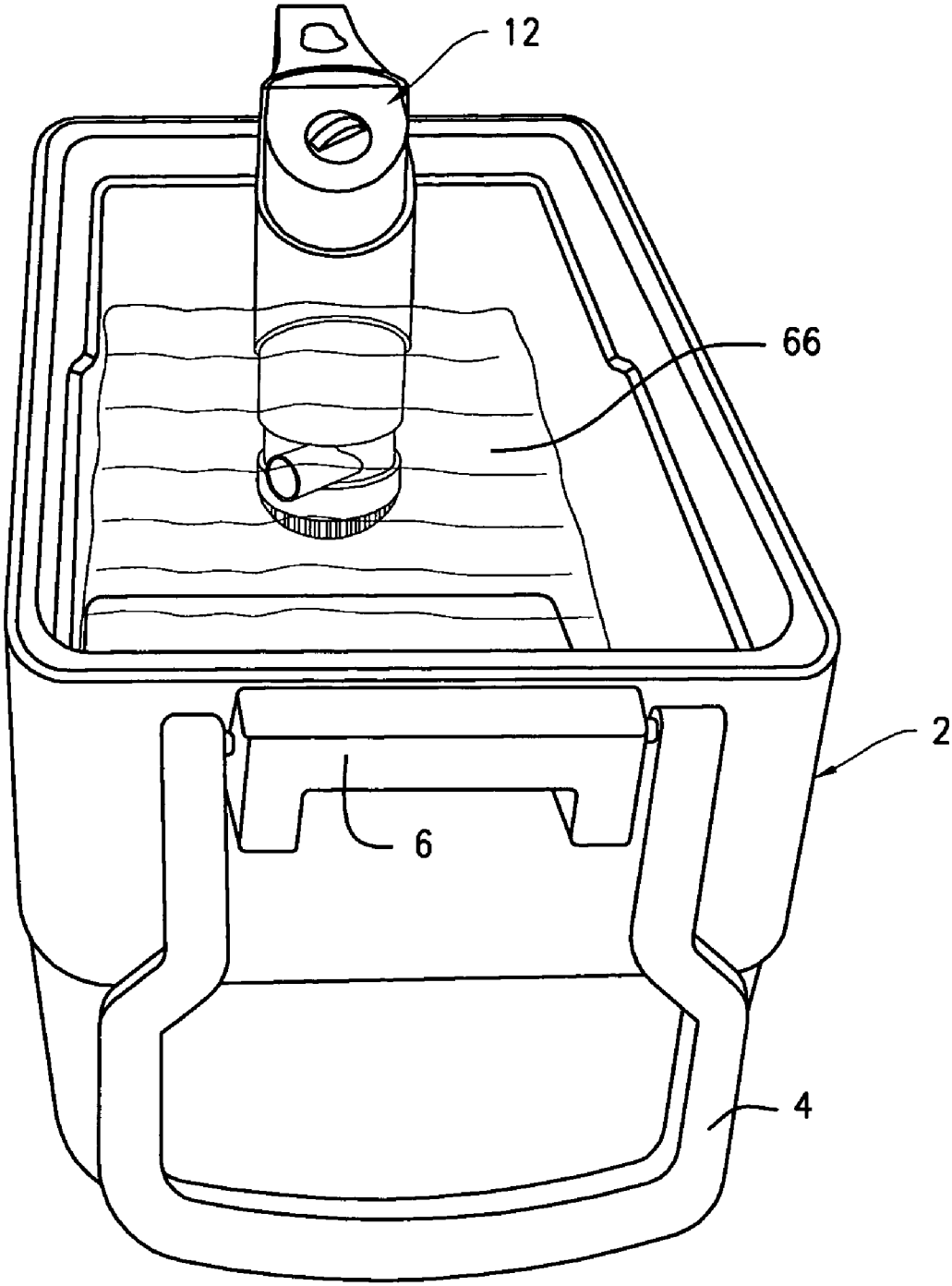
FIG. 6 shows a pictorial view of the vessel containing water, with the motorized water circulator or whirlpool device installed.
Figure 7:
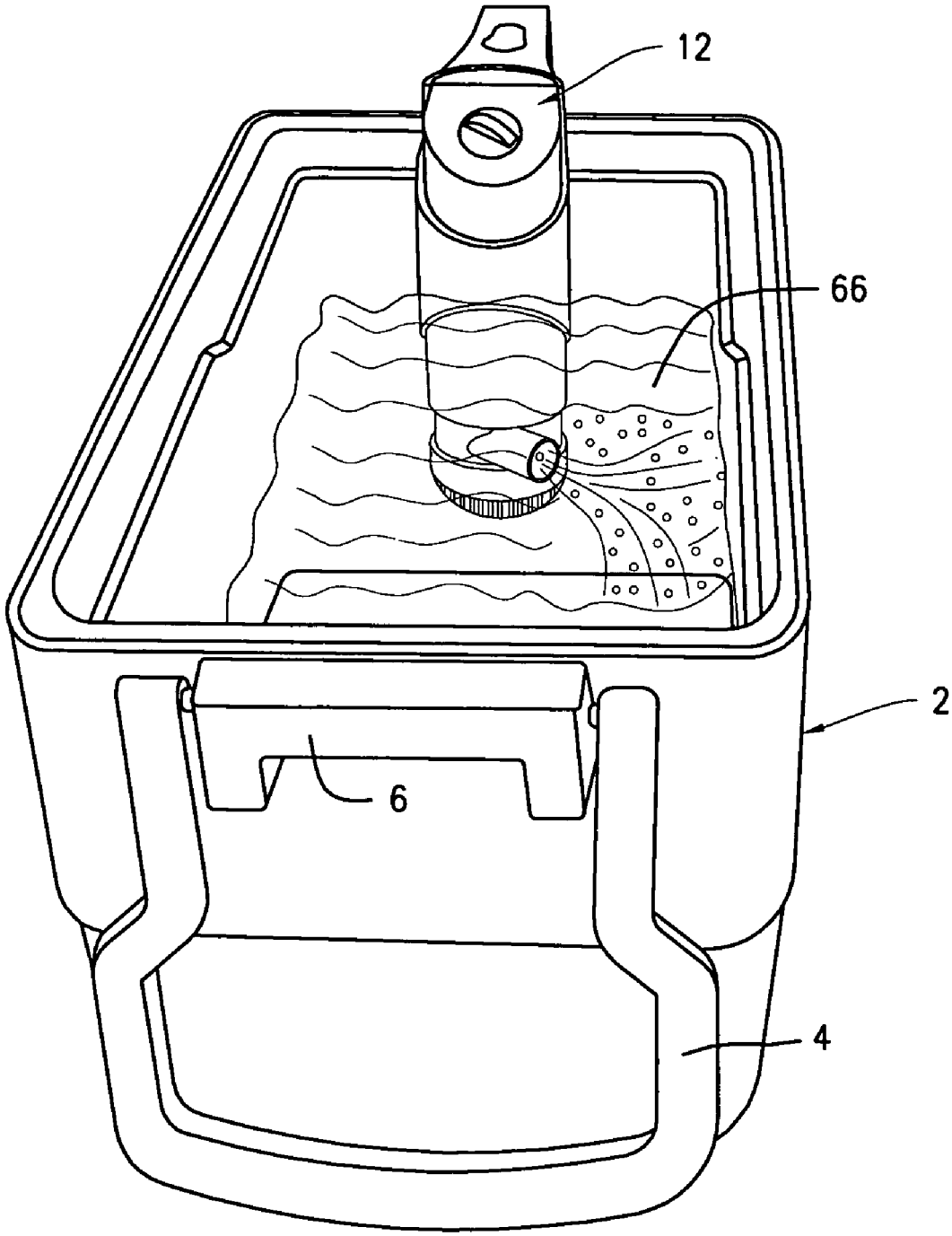
FIG. 7 shows a pictorial view of the vessel containing water with the motorized water circulator or whirlpool device energized for circulating the water.

FIG. 6 shows the water circulator 12 installed in the vessel 2, which has at least been partially filled with water 66. In FIG. 6 the power is not being applied to the water circulator 12, whereas in FIG. 7 power is being applied to the water circulator 12 which is causing bubbling and circulation of the water 66, as shown. As previously mentioned, the water 66 can be either chilled or hot, or at an elevated temperature above room temperature, suitable for treating a patient's foot, ankle, and/or calf. The size of the vessel 2 can be varied depending upon its intended use. For maximizing use of the present portable whirlpool bath system, the vessel 2 is typically dimensioned to be large enough and deep enough for permitting treatment of either one or a combination of a patient's toes, foot, ankle, and/or calf.

On completing a hydrotherapy treatment, the present whirlpool bath system or kit can be made ready for transport or storage in the following manner. First the drain plug 60 is released for draining the water 66 from the vessel 2, and if desired the interior thereof can be dried with a towel, for example. The plug 60 is then reinstalled, and the water circulator 12 and its associated components are removed from the vessel 2 and installed in the tray insert 10. The tray insert 10 is then installed in the vessel 2 as previously described. If the inverter 62 was used for providing power, it typically must first be removed from the vessel 2 before use for safety reasons, and must now be reinstalled in the interior or on the side of vessel 2 as previously indicated. The lid 24 is then installed on the top of the vessel 2, and the handle 4 is raised up in order to permit easy movement of the entire system for transport or storage.

In the preferred embodiment of the invention, the vessel 2, lid 24, handle 4, handle bracket 6, wheels 8, drain plug 60, and living hinge 61 all consist of a suitable plastic material. Also, in the preferred embodiment, vessel 2 is thermally insulated. Vessel 2 can consist of only a suitable plastic foam material, for example, or can consist of a thermally insulated material sandwiched between solid plastic outer and inside wall portions, and bottom portions. As previously mentioned, vessel 2 can be dimensioned in accordance with the particular application. For treating a typical patient's lower leg, ankle, foot, and/or calf, it is preferred that the vessel be 36 centimeters high, 65 centimeters long, and 34 centimeters wide, whereby it will be capable of retaining 50 quarts of water. The previously mentioned Conair BTS1R Water Jet or water circulator 12 with an engineering prototype is 30 centimeters high, 50 centimeters long, and 28 centimeters in diameter. However, the invention is not meant to be limited to the use of this particular water jet, in that the invention is applicable for use with any suitable water jet or water circulator 12. For purposes of safety, the water jet used, such as the example of the Conair unit must be equipped with a leakage circuit interrupter, which in this example is included in the power pack 48 (see FIG. 5). Also, the water jet front outlet 58 of water circulator 12 can in this example be turned in direction by moving the outlet 58 within a slotway 59, as shown in FIG. 5. Also, for the Conair unit 12 illustrated in this example, the unit includes a switch (not shown) that is adjustable for controlling the intensity of the water jet emitted from outlet 58.

As previously indicated, the present kit for providing a portable whirlpool bath or hydrotherapy system can readily be used by athletic trainers, clinicians, and other health care providers. The kit makes the system very easy to use. More specifically, to set up the system for use, the lid 24 is removed from the vessel 2, and the tray insert 10 is removed from the interior of the vessel and placed out of the way. The water circulator 12 components are removed from the tray insert 10, and the motorized pump 54 installed via the mounting bracket 38, the associated moveable bracket 40 and suction cup 42 securely onto an end of the vessel 2 as shown in FIG. 6. The motorized pump 54 is then plugged into its power pack 48, and the plug 52 from the power pack 48 is plugged into a typical AC outlet. However, if an AC outlet is not available, the inverter 62 is removed from the side of the vessel 2, and the plug 52 is plugged into the AC outlet 64 thereof. Note that for safety reasons before plugging the plug 52 into an available AC outlet, the vessel 2 should be filled with either cold water and ice, for treating sprains or strains, for example, or with warm water (for massaging effects). A fill line, not shown, is included in the vessel for ensuring that it is not overfilled with water. After plugging the plug 52 into a power outlet, the motorized pump 54 is turned on to an appropriate power setting for circulating the water. A patient is asked to insert one or both legs, feet, for treating lower leg injuries such as shin splints, foot and ankle sprains, turf toe, and so forth, as previously mentioned. Also, as previously mentioned, the vessel 2 can be dimensioned for providing treatment of injuries to patient's calf. After the treatment is completed, the patient is helped to remove their feet/leg or feet/legs from the vessel 2, motorized pump 54 is turned off, and plug 52 is removed from its associated AC outlet. Next, the drain plug 60 is removed, water 66 is drained from the vessel 2, the motorized pump 54 is removed, and the vessel 2 itself is dried. For sanitary purposes, the vessel 2 should be thoroughly washed with a bacteria fighting soap before reuse. The water circulator 12 and its various components are reinserted into the insert tray 10, the plug 60 is reinserted into its associated hole in the vessel 2, the tray insert 10 with the water circulator 12 components installed is itself reinstalled into the vessel 2, as previously indicated, and the lid 24 is reinstalled on the vessel 2. The hydrotherapy kit can now be moved to appropriate place for storage, or transported to another site, by raising the handle 4 to readily move the vessel 2 via the wheels 8.

Although various embodiments of the invention have been shown and described, they are not meant to be limiting. Those of skill in the art may recognize certain modification to these embodiments, which modifications are meant to be covered by the spirit and scope of the appended claims. For example, the water circulator 12 can be built into the vessel 2, rather than provided as a removable component. Also, an electric heating mechanism can be built into the vessel 2 for maintaining the water at a desired elevated temperature.

What is claimed is:

1. A kit for a portable hydrotherapy system comprises:

a vessel for containing water, said vessel having an open top;

opposing wheels being installed on opposing sides of and proximate at least one end of said vessel;

said vessel including an inwardly projecting circumferential ledge from interior sidewalls, said ledge being below the open top of said vessel;

a removable motorized water circulator system adapted for mounting on a portion of a wall of said vessel at one end thereof; and a tray insert configured for retaining components of said water circulator system during transport or storage of said kit, said tray having an uppermost projecting circumferential lip dimensioned for permitting bottom portions thereof to rest on a portion of said ledge of said vessel, for retaining said tray insert within said vessel.

2. The kit of claim 1, further including:

a lid for closing off the open top of said vessel, said lid being configured to include a bottom portion dimensioned to have a frictional fit between interior sidewalls of said vessel and rest upon top portions of the lip of said tray insert, and exposed portions of said ledge.

3. The kit of claim 1, wherein said vessel is thermally insulated.

4. The kit of claim 3, wherein said vessel includes plastic foam thermal insulating material.

5. The kit of claim 3, wherein said vessel includes hollow rigid plastic wall and bottom portions with thermal insulating material sandwiched therebetween.

6. The kit of claim 5, wherein said thermal insulating material is plastic foam.

7. The kit of claim 1, further including a collapsible handle mounted upon an exterior surface of another end of said vessel opposing said one end.

8. The kit of claim 7, wherein said handle consists of plastic material.

9. The kit of claim 1, wherein said ledge includes an uppermost section for receiving a bottom portion of said lid, and a lowermost portion for receiving a bottom portion of the lip of tray insert.

10. The kit of claim 1, wherein said vessel further includes a drain plug installed in a bottom side portion thereof.

11. The kit of claim 10, wherein said drain plug consists of plastic material.

12. The kit of claim 1, further including:

a battery powered power supply adapted for mounting on either one of interior and exterior side portions of said vessel, when not in use, and being removable for providing remote power to said water circulator system.

13. The kit of claim 1, wherein said lid includes a top portion larger than its bottom portion, the top portion having the same dimensions as the outer circumference of said vessel.

14. The kit of claim 13, wherein said lid consists of plastic material.

15. The kit of claim 1, wherein said lid consists of plastic material.

16. A kit for a portable hydrotherapy system comprises:

a vessel for containing water, said vessel having an open top;

opposing wheels being installed on opposing sides of and proximate at least one end of said vessel;

said vessel including an inwardly projecting circumferential ledge from interior sidewalls, said ledge being below the open top of said vessel;

a removable motorized water circulator system adapted for mounting on a portion of a wall of said vessel at one end thereof;

a tray insert configured for retaining components of said water circulator system during transport or storage of said kit, said tray having an uppermost projecting circumferential lip dimensioned for permitting bottom portions thereof to rest on a portion of said ledge of said vessel, for retaining said tray insert within said vessel; and a lid for closing off the open top of said vessel, said lid being configured to include a bottom portion dimensioned to have a frictional fit between interior sidewalls of said vessel and rest upon top portions of the lip of said tray insert, and exposed portions of said ledge.

17. The kit of claim 16, wherein said vessel is thermally insulated.

18. The kit of claim 16, further including a collapsible handle mounted upon an exterior surface of another end of said vessel opposing said one end.

19. The kit of claim 18, wherein said vessel, said lid, and said handle each consist of plastic material.

20. The kit of claim 16, wherein said ledge includes an uppermost section for receiving a bottom portion of said lid, and a lowermost portion for receiving a bottom portion of the lip of tray insert.

21. The kit of claim 16, wherein said vessel further includes a drain plug installed in a bottom side portion thereof.

22. The kit of claim 21, wherein said drain plug consists of plastic material, and includes a living hinge to retain it with said vessel lever unplugged for draining water from said vessel.

23. The kit of claim 16, further including:

a battery powered power supply adapted for mounting on either one of interior and exterior side portions of said vessel, when not in use, and being removable for providing remote power to said water circulator system.

24. The kit of claim 16, wherein said lid includes a top portion larger than its bottom portion, the top portion having the same dimensions as the outer circumference of said vessel.

* * * * *